United States Patent [19]

Grünewald et al.

[11] Patent Number: 4,864,913

[45] Date of Patent: Sep. 12, 1989

[54] AMMUNITION STOWAGE COMPARTMENT, PARTICULARLY IN BATTLE TANK TURRETS

[76] Inventors: Peter Grünewald, Kiefernweg 6, Fuldabrück I, Fed. Rep. of Germany; Uwe Sprafke, Klenzestr. 34, Kassel, Fed. Rep. of Germany

[21] Appl. No.: 744,890

[22] Filed: Nov. 19, 1976

[51] Int. Cl.[4] ..... F41H 5/20

[52] U.S. Cl. ..... 89/34; 89/36.13

[58] Field of Search ..... 89/34, 36 H, 36 K, 36 L, 89/34, 36.08, 36.13, 36.14

[56] References Cited

U.S. PATENT DOCUMENTS

| | | | |
|---|---|---|---|
| 2,594,198 | 4/1952 | Motley | 89/36 K |
| 3,139,031 | 6/1964 | Schroter et al. | 102/49.5 |
| 3,911,787 | 10/1975 | Seibel | 89/34 |
| 4,022,130 | 5/1977 | Johnson et al. | 102/56 R |
| 4,033,227 | 7/1977 | Eklund et al. | 89/36 H |

*Primary Examiner*—Stephen C. Bentley

*Attorney, Agent, or Firm*—Rogers & Killeen

[57] ABSTRACT

An ammunition bunker for the main battletank turrets which is arranged behind the tank turret and whose walls are designed by predetermined break lines such that, in the event of an explosion of ammunition in the bunker, its outside walls are hurled off the sides of the tank thereby protecting the crew of the tank.

11 Claims, 2 Drawing Sheets

AMMUNITION STOWAGE COMPARTMENT, PARTICULARLY IN BATTLE TANK TURRETS

The invention concerns an ammunition stowage compartment, particularly in battle tank turrets. Ammunition needed by battle tanks, and similar mobile weapons, must be carried so as to be readily available. It has been customary, up to now, to carry ammunition in battle tanks in the so-called combat compartment; that is, in the compartment in which the crew operating the weapon is located. The loader thus has direct access to the ammunition when loading the weapon. However, carrying ammunition in the combat compartment has the disadvantage that an explosion of the ammunition carried in the combat compartment, which is completely enclosed, and the result of some combat action, can cause total destruction of the combat compartment and can kill the crew. This danger is avoided, according to the invention, if the outside wall of the ammunition stowage compartment, which is separated from the combat compartment by a solid bulkhead, is made with built-in fracture lines in the form of indentations, or welds. It is desirable to have the individual sections between the fracture lines form vertical strips, the top and bottom ends of which rest against the roof and floor of the ammunition stowage compartment, respectively. The indentations that form the fracture lines can be worked into the outside walls of the tank from the outside, and an additional, thin, sheet of armor plate can be installed a short distance in front of the indented tank wall. The solid bulkhead of the ammunition stowage compartment, separating it from the combat compartment, has greater resistance to inside pressure than the outer walls of the ammunition stowage compartment. The loader has direct access to the ammunition if the ammunition stowage compartment is connected with the combat compartment by an ammunition access port that should be as small as possible, and that can be closed by a sliding door located in the side of the bulkhead separating the crew compartment from the ammunition stowage space, which faces the crew compartment. It is most advantageous when the ammunition in the ammunition stowage space is so arranged that the ammunition directly in front of the access port can be removed, and once removed, ammunition to the side can automatically move in front of the access port.

The figures illustrate one design of the object of the invention.

Figure 1:
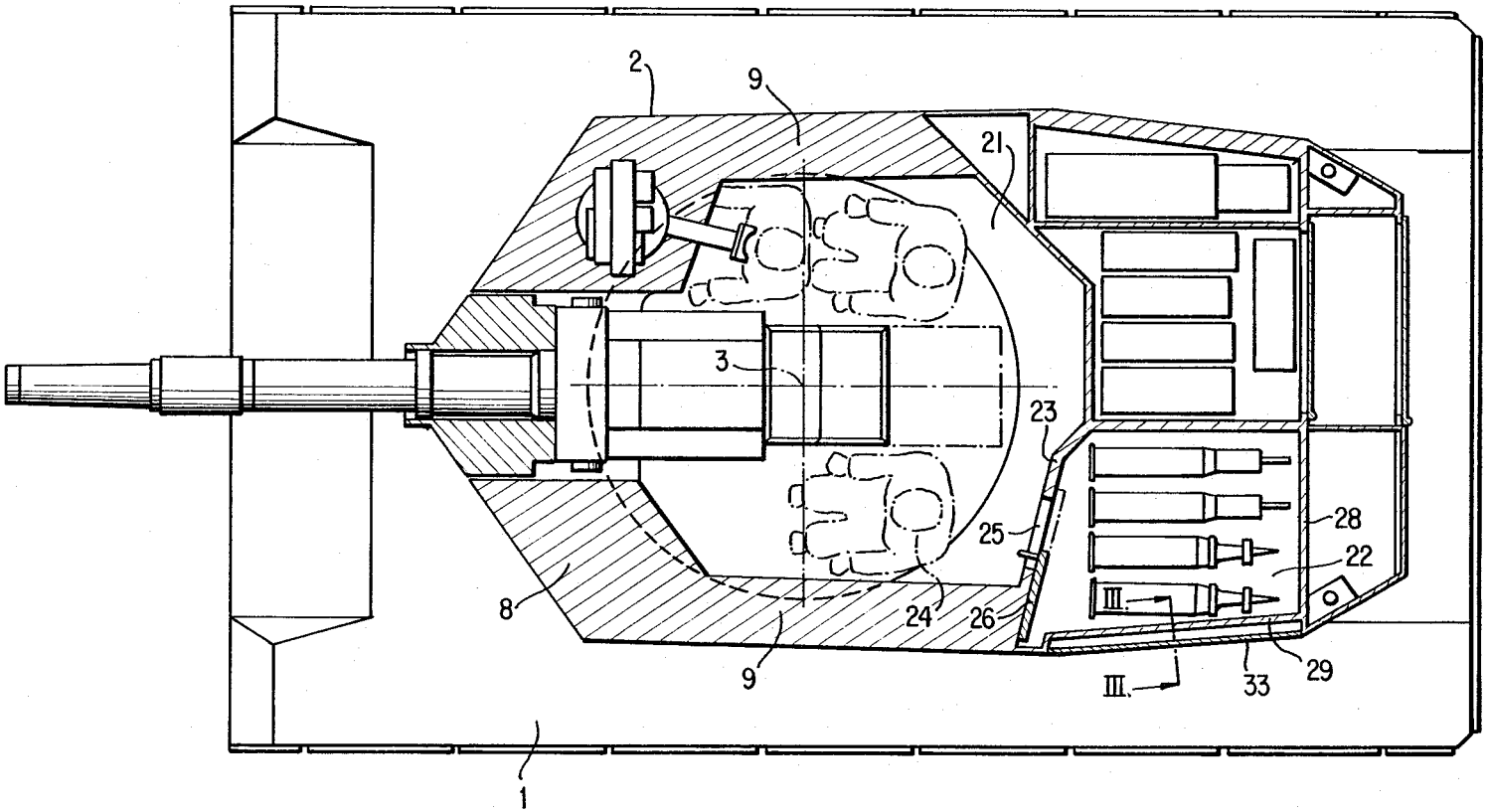
FIG. 1 is a horizontal section through a battle tank turret with an ammunition stowage compartment.
Figure 3:
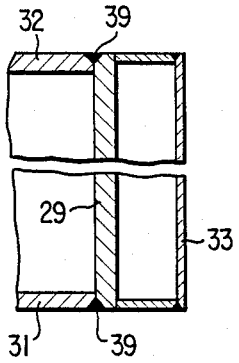
FIG. 3 is a section through III—III in FIG. 1 at a larger scale.

The battle tank, 1, indicated schematically in FIG. 1, has a turret, 2, which rotates about its vertical axis, 3. Combat compartment 21 is encased in particularly strong armor that consists of section 8, which protects against frontal fire, and sections 9, which protect against flanking fire. Ammunition stowage compartment 22 is located aft of the crew compartment. The ammunition stowage compartment is separated from combat compartment 21 by a particularly solid bulkhead 23, and arranged such that loader 24 has direct access to the ammunition, which he can easily reach through access port 25 in bulkhead 23. This port can be closed by sliding door 26, which is located in the side of bulkhead 23 facing ammunition stowage compartment 22. The door is compressed against bulkhead 23 when a compression wave occurs, resulting in combat compartment 21 becoming sealed off from ammunition stowage compartment 22, and as a result from burning powder residues and gases. Outer walls 27, 28, and 29 of the ammunition stowage compartment are segmented by vertical indentations 30, worked in from the outside. These indentations act as built-in fracture points. The top and bottom ends of the vertical strips formed by the indentations rest against floor plate 31 and against ceiling plate 32 (indicated by the stippled lines), so that the required ballistic strength to withstand an external load resulting from shelling is attained. Additional, thinner, armor plates, 33, not indented, are installed in front of this armor. Walls 27, 28, and 29, are connected to floor plate 31, ceiling plate 32, and to each other, by welds 39 (FIG. 3), made so they seal out water and chemical agents, but will fracture when a compression wave, the result of an internal load, forms. This design ensures that the ammunition stowage compartment meets tank-engineering requirements with respect to small caliber shelling and fragments, but on the other hand that the outside walls will fracture within a few milliseconds when there is large increase in pressure as a result of exploding ammunition, so that the load on bulkhead 25 of the combat compartment remains within the limits this bulkhead can withstand. The built-in indentations, 30, ensure that the outer walls will fracture when pressure increases inside the ammunition stowage compartment, and will, at the same time, fragment into small pieces, so that relatively small masses are accelerated and the pressure in the ammunition stowage compartment decreases rapidly.

Figure 2:
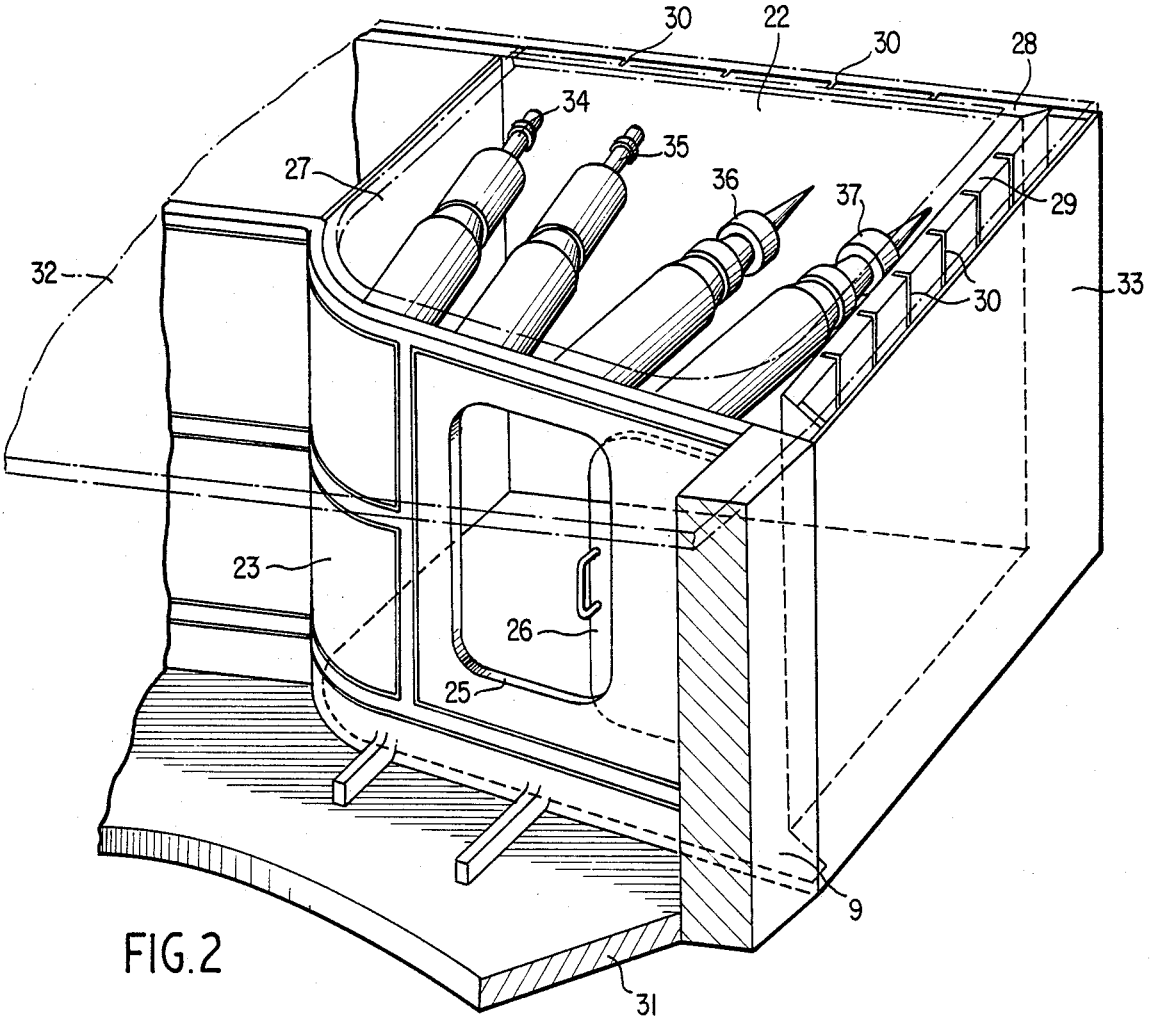
FIG. 2 shows in perspective, and at a larger scale, the ammunition stowage compartment with the top armor removed.

Ammunition 34 to 37 in ammunition stowage compartment 22 is arranged so that the warheads face away from combat compartment 21 and the type of ammunition needed in each case can readily be removed through access port 25. FIG. 2 is an example of four shells lying in the same plane, with only the top layer shown in the figure. Shells 35 or 36, lying in the middle, can be removed through access port 25. Feed systems, not shown, can be used to move the shells to the right and left of the access port to the center with their bases close enough to the port so that ammunition can be removed, when the center shells are removed. Sliding door 26 is mounted on rollers, and is designed to withstand the same load as bulkhead 23.

We claim:

1. Ammunition bunker for main battletank turrets which is arranged behind the crew's compartment and separated from the latter by a fixed wall whereby the outside walls of the bunker are connected with the hull roof plate and the floor of the bunker by welding seams acting as predetermined break lines.

2. Ammunition bunker according to claim 1 in which the wall of the ammunition bunker, through which the latter is separated from the combat compartment, is more resistant to internal pressure than the outside walls.

3. Ammunition bunker according to claim 1 which is connected with the combat compartment by a removal hatch which can be closed by means of a sliding door which is arranged on the side of the partition wall between the crew's compartment and ammunition bunker facing the ammunition bunker.

4. Ammunition bunker for main battletank turrets which is arranged behind the crew's compartment and separated from the latter by a fixed wall whereby the outside walls of the bunker are supported from the outside against the hull roof plate and against the floor and connected with this by welding seams used as predetermined break lines.

5. Ammunition bunker according to claim 4 in which the wall of the ammunition bunker, through which the latter is separated from the combat compartment, is more resistant to internal pressure than the outside wall.

6. Ammunition bunker according to claim 4 which is connected with the combat compartment by a removal hatch which can be closed by means of a sliding door which is arranged on the side of the partition wall between the crew's compartment and ammunition bunker facing the ammunition bunker.

7. Ammunition bunker for main battletank turrets which is arranged behind the crew's compartment and separated from the latter by a fixed wall whereby the outside walls are divided into vertical strips by vertical slots used as predetermined break lines and the upper and lower ends of these strips are supported from the outside against the hull roof plate or the floor of the bunker and are connected with these by welding seams used as predetermined break lines.

8. Ammunition bunker according to claim 7 in which the vertical slots are incorporated from the outside into the external armor walls.

9. Ammunition bunker according to claim 7 in which at a short distance in front of the outside walls provided with slots there is in each case a thin wall made of armor plate.

10. Ammunition bunker according to claim 7 in which the wall of the ammunition bunker, through which the latter is separated from the combat compartment, is more resistant to internal pressure than the outside walls.

11. Ammunition bunker according to claim 7 which is connected with the combat compartment by a removal hatch which can be closed by means of a sliding door which is arranged on the side of the partition wall between the crew's compartment and ammunition bunker facing the ammunition bunker.

* * * * *